United States Patent [19]

Gillard

[11] Patent Number: 5,047,788

[45] Date of Patent: Sep. 10, 1991

[54] FIGURE CONTROL SYSTEM FOR A FLEXIBLE ANTENNA

[75] Inventor: Calvin W. Gillard, Palo Alto, Calif.

[73] Assignee: Lockheed Missiles & Space Company, Inc., Sunnyvale, Calif.

[21] Appl. No.: 417,604

[22] Filed: Oct. 5, 1989

[51] Int. Cl.[5] ..... H01Q 15/20

[52] U.S. Cl. ..... 343/915; 343/721; 343/894; 343/DIG. 2

[58] Field of Search ..... 343/915, 721, 703, 894, 343/DIG. 2

[56] References Cited

U.S. PATENT DOCUMENTS

| | | | |
|---|---|---|---|
| 908,838 | 1/1909 | Brown | 343/915 |
| 3,262,121 | 7/1966 | Holloway | 343/721 |
| 3,540,048 | 11/1970 | Clemens, Jr. et al. | 343/915 |
| 3,939,478 | 2/1976 | Lorch | 343/721 |

*Primary Examiner*—Rolf Hille
*Assistant Examiner*—Hoanganh Le
*Attorney, Agent, or Firm*—John J. Morrissey

[57] ABSTRACT

The figure of an unfurled antenna comprising a radio-frequency reflective fabric (10) is mapped and controlled by a system comprising a plurality of light-emitting devices (14, 15) mounted at precisely specified locations on ribs (11), which support the fabric (10). Light from each of the light-emitting devices (14, 15) passes through a corresponding window assembly (16) on a hub (12), which support the ribs (11) and also houses a telescope of the Schmidt-Cassegrain type. A biconical reflector (27) mounted within the hub (12) directs rays of light from all the light-emitting devices (14, 15) to a primary mirror (21) of the telescope, from which the rays are reflected to a secondary mirror (22), which focuses the rays so as to form images on photodetector arrays (31) and (32). The images formed on the photodetector arrays (31) and (32) are swaths of light, which cross the photodetector arrays (31) and (32) at positions determined by the actual positions of the light-emitting devices (14, 15). Determination of centroid positions of the swaths of light crossing the photodetector arrays (31) and (32) enables the actual figure of the antenna to be mapped. Electronic signals generated by the photodetector arrays (31) and (32) are processed by a processor (35), which compares the actual figure of the antenna with a specified figure, and which generates electronic signals to activate actuator mechanisms (38) to move individual ribs (11) as necessary to bring the actual figure of the antenna into conformity with the specified figure.

10 Claims, 7 Drawing Sheets

100
110
111
120
130
140
141
142
143
144
145
146
150
151
152
154
155
156
160
161
162
170
171
172
180
181
182

FIGURE CONTROL SYSTEM FOR A FLEXIBLE ANTENNA

TECHNICAL FIELD

This invention relates generally to flexible antennas, and more particularly to an electro-optical technique for measuring and adjustably controlling the surface configuration of a large space-based unfurlable antenna.

BACKGROUND OF THE INVENTION

The surface configuration of a high-gain radio-frequency transmitting and/or receiving antenna (e.g., a large unfurlable antenna for deployment from a satellite or spacecraft in extraterrestrial space) ordinarily must conform to a precisely specified configuration, typically a parabolic configuration, in order to achieve diffraction-limited performance. However, the requirements of light-weight construction and thermal stability imposed by the constraints of typical applications in extraterrestrial space often preclude such an antenna from having the rigidity necessary to ensure that the actual surface configuration remains continuously in conformity with the specified surface configuration during an extended period of antenna operation.

Engineers involved in antenna technology customarily refer to the surface configuration of an antenna as the antenna's "figure". A system for monitoring the actual surface configuration (i.e., the figure) of an antenna, and for generating correction signals to change the actual surface configuration as required to maintain conformity with a specified surface configuration, is called a figure control system.

Proposals for figure control systems for use with large space-based unfurlable antennas have been described in the following documents:

1) C. C. Huang et al., "Structure Alignment Sensor Feasibility Demonstration", Lockheed Missiles & Space Company, Inc., Report No. D644951, 1978.

2) R. S. Neiswander, "Conceptual Design of a Surface Measurement System for Large Deployable Space Antennas", Proceedings: Large Space Systems Technology Conference, NASA Langley Research Center, 1981.

3) P. W. Collyer et al., "Electro-Optical System for Remote Position Measurement in Real Time", Proceedings: Large Space Systems Technology Conference, NASA Langley Research Center, 1981.

4) M. Berdahl, "Surface Measurement System Development", Proceedings: Large Space Systems Technology Conference, NASA Langley Research Center, 1981.

5) J. M. McLauchlan, "Spatial High-Accuracy Position-Encoding Sensor (SHAPES) for Large Space System Control Applications", Proceedings: Large Space Systems Technology Conference, NASA Langley Research Center, 1981.

Applications presently contemplated for large space-based unfurlable antennas require that the figure of the antenna be accurate to within 1/50 of the wavelength of the signal being transmitted and/or received, where the signal would have a frequency as high as 100 GHz. Such applications would require a measurement accuracy of about 0.06 mm in mapping the figure of the antenna at a measurement data rate of about 50 Hz. In contrast with such requirements, the measurement accuracies achievable with the antenna figure control systems previously proposed are from about 0.5 mm to about 0.15 mm (depending upon the particular system) at a measurement data rate of only about 10 Hz.

SUMMARY OF THE INVENTION

It is an object of the present invention to provide an antenna figure control system that optically senses the actual surface configuration (i.e., the actual figure) of a flexible antenna, and that generates electronic signals as necessary to actuate mechanisms for changing the actual figure of the antenna so as to conform to a specified figure.

In accordance with an exemplary embodiment of the present invention, a radio-frequency reflective fabric is attached to a framework comprising an array of ribs extending radially from a hub. The hub is a hollow cylindrical structure that functions as a mounting for the ribs and as a housing for a telescope of the Schmidt-Cassegrain type. The fabric is supported by the ribs to form an antenna whose actual surface configuration is generally in conformity with a specified surface configuration. Each rib is attached to the hub by means of a hinged joint, and mechanisms are mounted on the hub to enable individual ribs to be rotated about their respective joints in order to change the orientations of the ribs relative to the hub. The antenna formed by the fabric attached to the ribs changes its surface configuration (i.e., its figure) as the orientations of the ribs are changed, whereby the figure of the antenna can be adjustably controlled.

In the exemplary embodiment, two optical beam sources are mounted at precisely specified locations on each rib. Each of the optical beam sources on each of the ribs projects a beam of light (preferably monochromatic) to a corresponding window on the hollow cylindrical hub. The beams from all the optical beam sources on all the ribs are internally reflected and focussed by the telescope housed within the hub onto corresponding arrays of photoelectric devices. Electronic signals generated by the photoelectric devices provide measurements of the angular positions of the individual optical beam sources (i.e., measurements of the locations at which the individual optical beam sources are mounted on the ribs) relative to the hub.

Measurements of the angular positions of the two optical beam sources on each particular rib relative to the hub indicate the actual orientation of the particular rib relative to the hub. Electronic signals indicating the actual orientations of all the ribs are compared by a signal processor with predetermined orientations required of the ribs in order to produce the specified surface configuration for the antenna. Correction signals are generated by the signal processor to actuate corresponding mechanisms for rotating particular ribs individually about their hinged joints as necessary to change the orientations of the particular ribs so as to maintain the specified surface configuration for the antenna.

The technique of the present invention for measuring and controlling the figure of an antenna is not dependent upon the size of the antenna, or upon the shape desired for the figure of the antenna, or upon the means by which the antenna is supported. In principle, the technique of the present invention could be implemented for a small-scale antenna such as would be required for a portable communications station as well as for a large-scale space-based antenna, for a planar antenna as well as for a parabolic antenna, and for an antenna supported by means other than ribs extending from a hub. The technique of the present invention could also be used in an application where figure measurement and control are achieved by electronic phase correction of individual elements in an array of antenna elements, rather than by mechanical adjustment of supporting structures. Furthermore, the technique of the present invention is not limited to figure control for radio-frequency antennas, but could also be used for controlling the figures of such structures as reflectors for infrared-frequency and visible-frequency telescopes.

DESCRIPTIONS OF THE DRAWINGS

BEST MODE OF CARRYING OUT THE INVENTION

Figure 1:
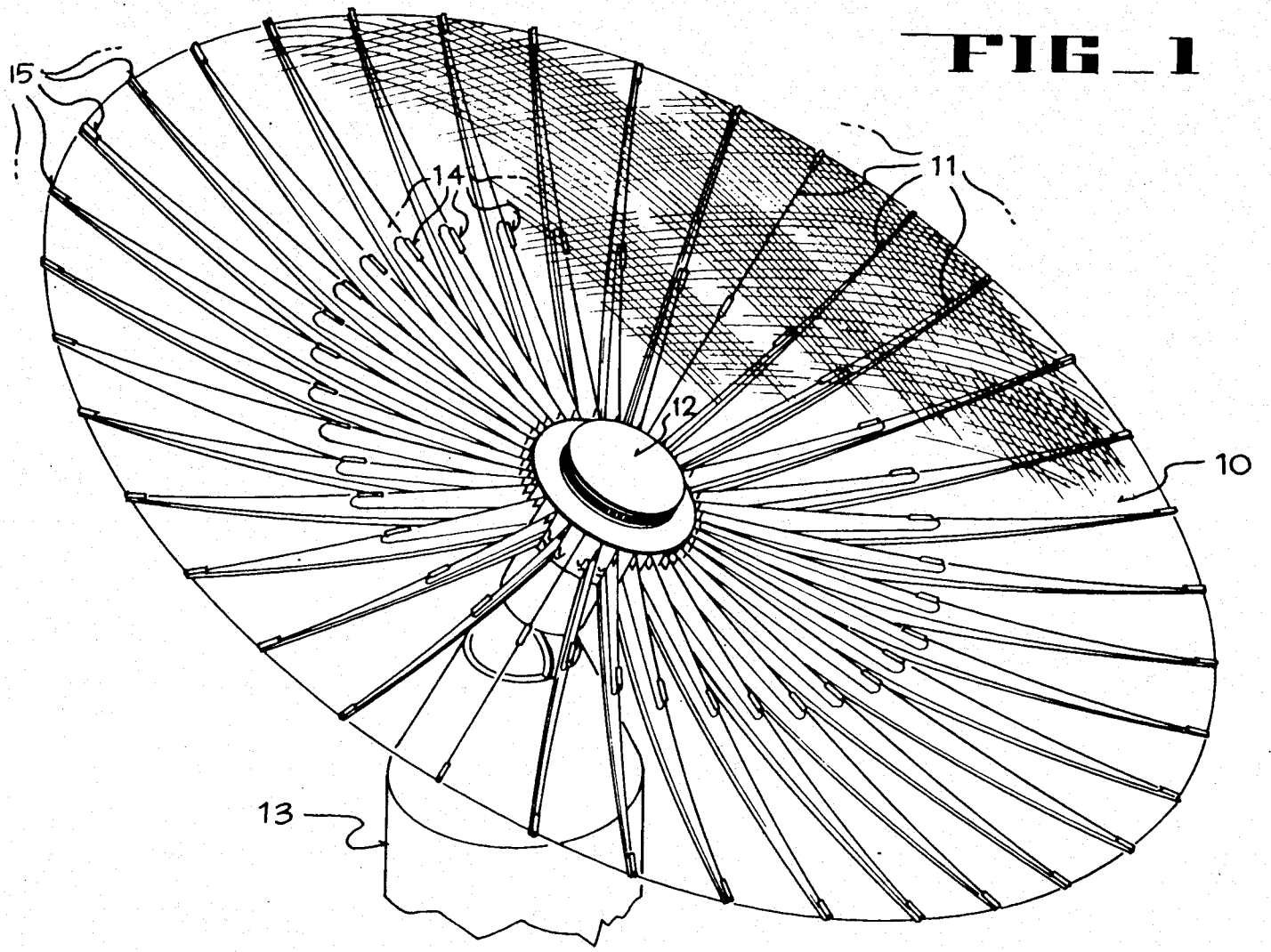
FIG. 1 is a perspective view of an unfurled antenna and its associated figure control system according to the present invention.

FIG. 1 shows a large unfurled antenna comprising a radio-frequency reflective fabric 10, which is secured to an array of ribs 11 extending generally radially outward from a hollow circularly cylindrical hub 12. The ribs 11 are movable from a closed disposition to an open disposition, whereby the antenna can be transformed from a furled configuration (not shown) to the unfurled configuration illustrated in FIG. 1. When in closed disposition, the ribs 11 keep the fabric 10 properly stowed until the antenna is to become operational. When in open disposition, the ribs 11 maintain the fabric 10 in a relatively taut condition with a generally paraboloidal surface configuration. The hub 12 functions both as a support structure for the ribs 11 and as a housing for a telescope of the Schmidt-Cassegrain type.

The hub 12 is shown pivotally mounted in a conventional manner upon a mast 13, which projects from a structure (not shown) that could be part of, e.g., a ground-based stationary platform or an automotive vehicle. In a particular application presently contemplated by the inventor, the antenna illustrated in FIG. 1 is an unfurlable radio-frequency transmitting and/or receiving antenna for deployment from a satellite or a spacecraft, and the mast 13 projects from a structural member of the satellite or spacecraft. Preferably, the hub 12 can be controllably pivoted on the mast 13 to assume a selected orientation upon command, whereby the gain of the antenna can be optimized at any particular time.

As illustrated in FIG. 1, the reflective fabric 10 is secured to thirty-six ribs 11, which are evenly spaced at approximately 10-degree intervals around the hub 12. However, in a contemplated application for the present invention, the number of ribs 11 supporting the fabric 10 would be fifty or more. In principle, implementation of the present invention does not depend upon the size of the antenna. However, for an indication of the dimensions involved in applications contemplated for the present invention, it is instructive to visualize the ribs 11 as being about 100 feet long with a depth of about 10 to 18 inches at the proximal ends adjacent the hub 12. Taking the thicknesses of the ribs 11 into account for a 50-rib antenna, each gore (i.e., triangular portion) of the reflective fabric 10 between adjacent ribs 11 would have an angular width of about six degrees.

Light-emitting devices 14 and 15 are mounted at precisely specified locations on each of the ribs 11. In the embodiment illustrated in FIG. 1, the light-emitting devices 14 are mounted at mid-positions on the ribs 11, and the light-emitting devices 15 are mounted at the outer tips of the ribs 11. Each of the light-emitting devices 14 and 15 on each of the ribs 11 directs a beam of light toward a corresponding window on the cylindrical surface of the hub 12. Since there are two light-emitting devices 14 and 15 on each rib 11, there are twice as many windows on the cylindrical surface of the hub 12 as there are ribs 11 extending radially from the hub 12. Each window on the cylindrical surface of the hub 12 is configured as an elongate slit extending parallel to the cylindrical axis of the hub 12. All the window slits on the hub 12 are parallel to each other with equal spacings between adjacent window slits. Top ends of all the window slits lie in a first plane perpendicular to the cylindrical axis of the hub 12, and bottom ends of all the window slits lie in a second plane also perpendicular to the cylindrical axis of the hub 12. Either the first or the second plane can be designated as a reference plane.

The angle between the cylindrical axis of the hub 12 and the beam of light that enters a particular window slit from a corresponding one of the light-emitting devices 14 or 15 provides a measurement of the location of the corresponding light-emitting device 14 or 15 relative to the cylindrical axis of the hub 12 and the designated reference plane. Measurements of the locations of the two light-emitting devices 14 and 15 on each rib 11 relative to the cylindrical axis of the hub 12 and the designated reference plane provide a precise indication of the orientation of each rib 11. Determination of the orientations of all the ribs 11 enables the surface configuration of the reflective fabric 10 secured to the ribs 11 (i.e., the figure of the antenna) to be mapped. The antenna figure control system of the present invention senses changes in the figure of the antenna, and generates correction signals as necessary to adjust the orientations of particular ribs 11 so as to maintain a specified figure for the antenna.

Figure 2:
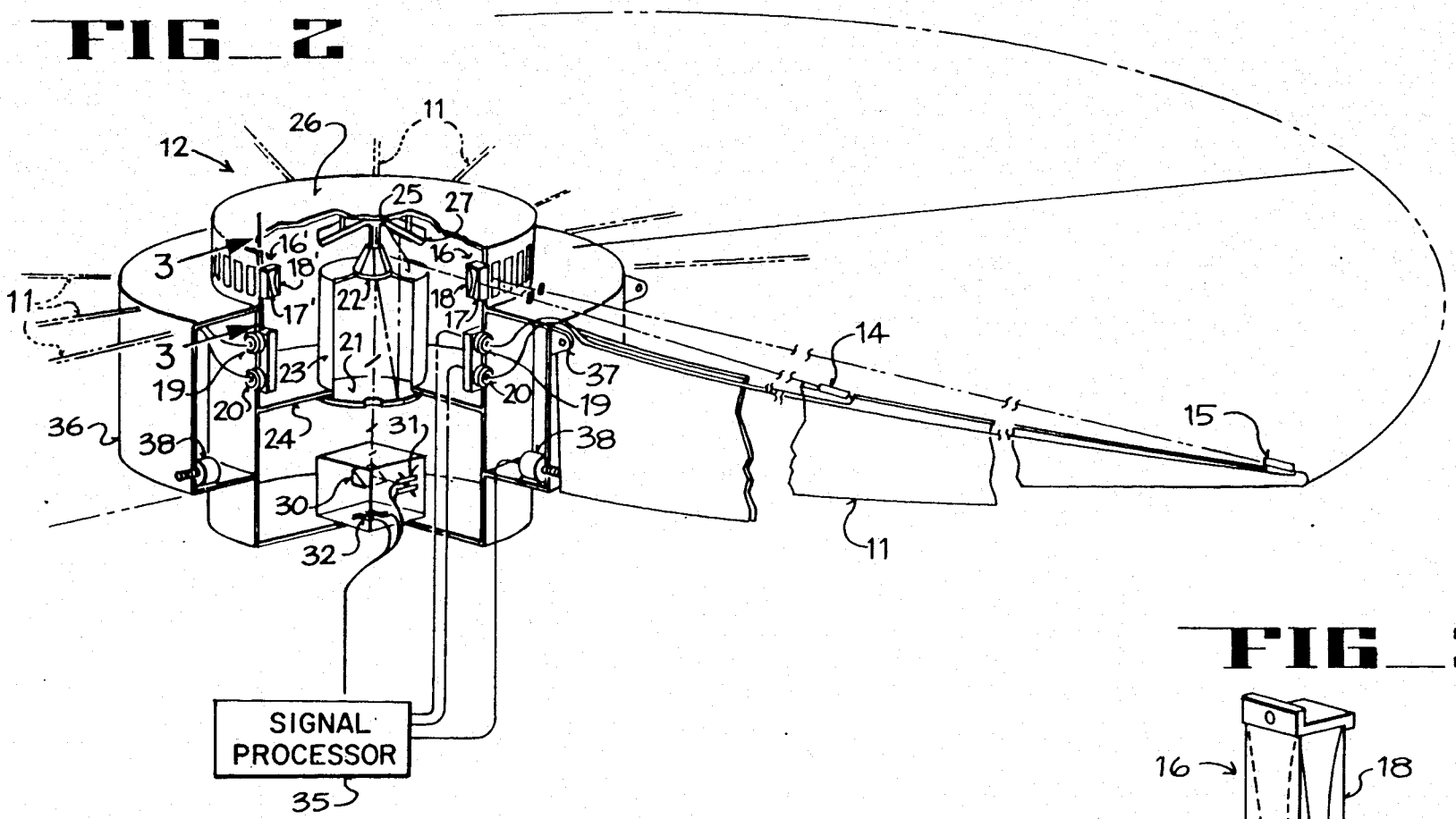
FIG. 2 is a cut-away perspective view of the antenna figure control system of FIG. 1.

As illustrated in the cut-away perspective view of FIG. 2, window assemblies 16 are mounted in corresponding window slits on the cylindrical surface of the hub 12. Beams of light from corresponding light-emitting devices 14, which are precisely located at mid-rib positions on the ribs 11, enter through the window assemblies 16 into the interior of the hub 12 to be gathered by the Schmidt-Cassegrain telescope housed therein. Similarly, window assemblies 16' are mounted in corresponding window slits on the cylindrical surface of the hub 12 so that each window assembly 16' is positioned between a pair of adjacent window assemblies 16. Beams of light from corresponding light-emitting devices 15, which are precisely located on the outer tips of the ribs 11, enter through the window assemblies 16' into the interior of the hub 12 to be gathered by the Schmidt-Cassegrain telescope. The window assemblies 16 and 16' alternate with respect to each other in the band of window slits around the cylindrical surface of the hub 12.

Figure 3:
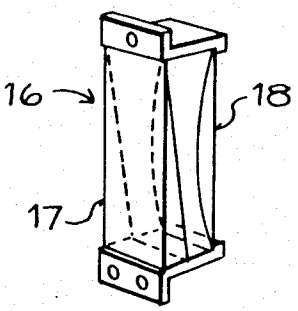
FIG. 3 is a perspective view of a window assembly of the antenna figure control system shown in FIG. 2.

As shown in enlarged detail in FIG. 3, each window assembly 16 comprises a prism 17 mounted at the entrance of the window slit, and a converging lens 18 mounted behind the prism 17. The prism 17 has a precisely determined apex angle corresponding to the angular position that the light-emitting device 14 is supposed to assume relative to the cylindrical axis of the hub 12 and the designated reference plane, when the rib 11 on which the light-emitting device 14 is mounted is properly oriented so as to provide the required figure for the antenna. The prisms 17 of all the window assemblies 16 to which the beams of light from the light-emitting devices 14 are directed all have the same apex angle, which is different from the apex angle that is common to the prisms 17' of the window assemblies 16' to which the beams of light from the light-emitting devices 15 are directed.

Preferably, each of the light-emitting devices 14 and 15 comprises a self-focussing lens attached to an end of a corresponding optical fiber. Light is channelled via the optical fiber to the self-focussing lens from a corresponding light source mounted on the hub 12. As shown in FIG. 2, light sources 19 and 20 are mounted on the hub 12 to deliver light through corresponding optical fibers to the light-emitting devices 14 and 15, respectively. The light sources 19 and 20 can be conventional light-emitting diodes (LED's) or laser diodes. Self-focussing lenses suitable for the light-emitting devices 14 and 15 are marketed as "Selfoc" lenses by Nippon Sheet Glass America, Inc. (NSG), which has sales offices in Somerset, N.J. NSG also markets an optical fiber having a Selfoc lens integrally formed at one end thereof, which is particularly suitable for use in an antenna figure control system according to the present invention. The optical fibers delivering light from the light sources 19 and 20 to the corresponding self-focussing lenses of the light-emitting devices 14 and 15 are typically about 0.1 mm in diameter, and are bonded (as by epoxy) to the respective ribs 11 so as not to interfere with furling and unfurling of the antenna.

Radio-frequency reflective fabrics are available from vendors such as Continental Warp Knit Corporation of Angier, N.C. and Fabric Development Company of Quakertown, Pa. A material especially suitable for use as the reflective fabric 10 is described in U.S. patent application Ser. No. 123,843 assigned to Lockheed Missiles & Space Company, Inc. If the reflective fabric 10 is substantially transparent to optical radiation, the light-emitting devices 14 and 15 could be positioned on the convex side (i.e., the underside) of the antenna formed by the fabric 10 when the ribs 11 are in open disposition. However, in the preferred embodiment of the invention, the optical fibers are run along the concave side (i.e., the radio-frequency reflective side) of the antenna formed by the fabric 10 over the corresponding ribs 11 to which the reflective fabric 10 is attached, whereby the light-emitting devices 14 and 15 can be positioned on the concave side of the antenna.

Selfoc lenses used as the light-emitting devices 14 and 15 serve to direct beams of light to the corresponding window slits on the cylindrical surface of the hub 12 in narrow (about 0.5 degree) cones of illumination. The window slits are precisely positioned with respect to the light-emitting devices 14 and 15, and are precisely separated from each other, so that each window slit can admit light from its corresponding light-emitting device 14 or 15 on a particular rib 11 without significant "cross-talk" from other light-emitting devices 14 and 15 on other ribs 11.

Axially mounted within the hollow cylindrical hub 12 is the Schmidt-Cassegrain telescope, which comprises a primary mirror 21 having a spherical surface configuration and a secondary mirror 22 having a hyperboloidal surface configuration. The primary mirror 21 and the secondary mirror 22 are symmetrical about corresponding axes of revolution that coincide with each other and with the cylindrical axis of the hub 12. The primary mirror 21 has a central aperture of circular perimeter, whose center lies on the cylindrical axis of the hub 12. In the embodiment illustrated in FIG. 2, the primary and secondary mirrors 21 and 22 are mounted in fixed disposition with respect to each other within a cylindrical casing 23. A support plate 24 extends inwardly from the cylindrical surface of the hub 12 to the cylindrical casing 23, and supports the casing 23 so that the cylindrical axis of the casing 23 coincides with the cylindrical axis of the hub 12. The primary mirror 21 is secured to one end, and a Schmidt corrector plate 25 is secured to the other end of the casing 23. A circular cover plate 26 closes a top end of the cylindrical hub 12.

A biconical reflector 27, which is a novel structure designed to implement the present invention, is bonded to the Schmidt corrector plate 25 (as by optical cement) so as to extend toward the cover plate 26. The biconical reflector 27 is symmetrically configured about an axis of symmetry, and is mounted on the Schmidt corrector plate 25 as illustrated in cross-sectional detail in FIG. 4 so that the axis of symmetry of the biconical reflector 27 coincides with the cylindrical axis of the casing 23. The secondary mirror 22 is bonded to a central portion of the Schmidt corrector plate 25 (as by optical cement) so as to face the primary mirror 21. The biconical reflector 27 has two conical reflective surfaces 28 and 29, both of which are symmetrical about the axis of symmetry thereof.

Rays of light entering any particular window slit on the cylindrical surface of the hub 12 from a corresponding particular one of the light-emitting devices 14 and 15 impinge upon the reflective surface 28 at a nonperpendicular angle of incidence, and are reflected from the surface 28 to the reflective surface 29, and thence through the Schmidt corrector plate 25 to the primary mirror 21. The Schmidt corrector plate 25 refracts the rays of light directed to the primary mirror 21 by a precisely predetermined amount so as to correct for spherical aberration produced by the spherical surface of the primary mirror 21. The biconical reflector 27 redirects the rays of light from all of the light-emitting devices 14 and 15 disposed radially around the hub 12 into parallel rays, which are gathered by the primary mirror 21 and reflected therefrom to the secondary mirror 22.

The biconical reflector 27 is preferably an integral structure fabricated from a single piece of metal (e.g., 6061-T6 aluminum alloy). The conical reflective surfaces 28 and 29 can be formed on the biconical reflector 27 by diamond-turning the piece of aluminum alloy on an air-bearing lathe. The resulting surfaces 28 and 29, which are left unpolished, are highly specular and are very nearly diffraction limited. In the particular embodiment illustrated in FIG. 2, the biconical reflector 27 is configured so that a cross section thereof in any plane that includes the axis of symmetry has the configuration of a conventional pentaprism. Thus, the biconical reflector 27 functions in the manner of a circularly cylindrical pentaprism defining a flat reference plane, which coincides with the designated reference plane perpendicular to the cylindrical axis of the hub 12. Light rays directed to the biconical reflector 27 are deviated from the designated reference plane by the prism 17 and the converging lens 18 of each of the window assemblies 16. For certain antenna configurations, it might be preferable for the biconical reflector 27 to be configured so as to define a conical (rather than a planar) reference surface.

Figure 4:
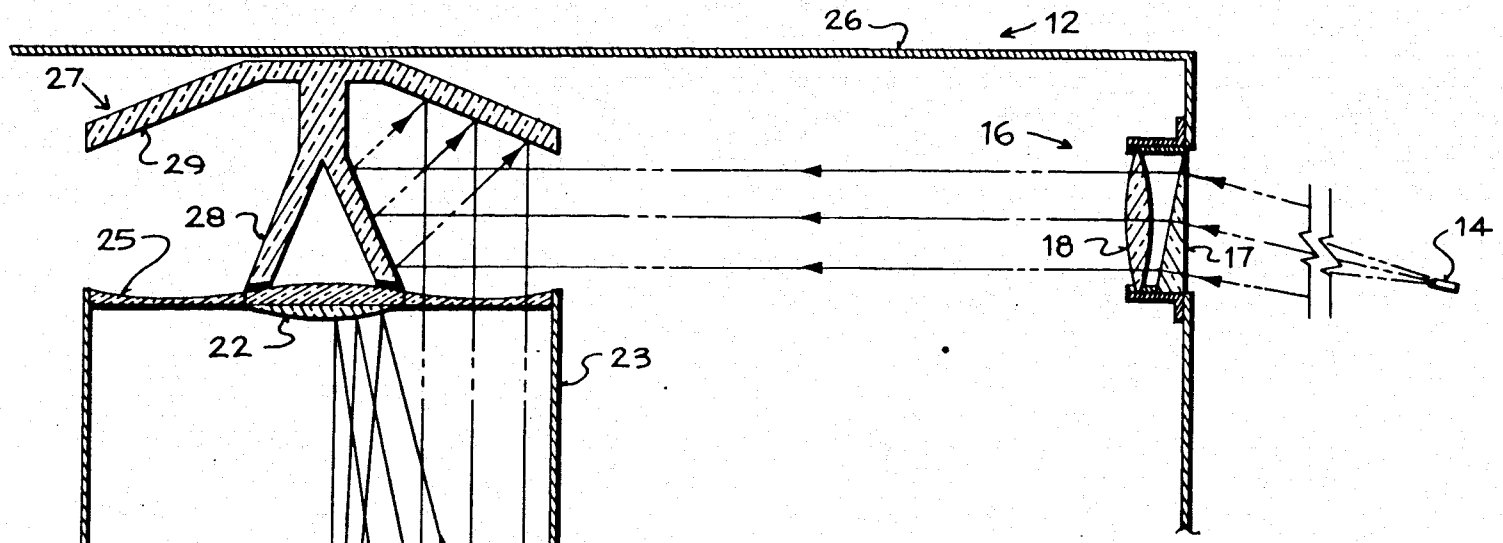
FIG. 4 is a cross-sectional view of a portion of the hub of the antenna figure control shown in FIG. 2 in which optical paths are illustrated for three rays of light originating at a light source mounted at a mid-position on one of the ribs supporting the antenna.

In FIG. 4, paths are traced for three rays of light originating at the light-emitting device 14 located at the mid-position of a representative one of the ribs 11. The three rays are shown passing through the window assembly 16 so as to impinge upon the conical reflective surface 28 at a predetermined angle of incidence, which is determined by the apex angle of the prism 17 of the window assembly 16. The converging lens 18 of the window assembly 16 serves to redirect all the rays of light originating at the light-emitting device 14 into a collimated beam. The rays are reflected from the surface 28 to the surface 29, and are then reflected from the surface 29 through the Schmidt corrector plate 25 to the primary mirror 21 in a direction generally parallel to the axis of revolution thereof (which coincides with the cylindrical axis of the casing 23).

The rays of light impinging upon the primary mirror 21 are reflected therefrom to the hyperboloidal secondary mirror 22, which reflects the rays in a converging beam through the central aperture in the primary mirror 21 to a beamsplitter 30. The beamsplitter 30 "folds" (i.e., reflects) a portion of the converging beam to a first focal plane located on a first array of photodetectors 31, and transmits the remainder of the converging beam to a second focal plane located on a second array of photodetectors 32, where the first and second photodetector arrays 31 and 32 are disposed preferably orthogonally with respect to each other.

In operation, the light-emitting devices 14 and 15 can be caused to emit corresponding beams of light in sequentially activated groups (perhaps as few as three or four groups) with a pulse duration of about two milliseconds for each group. For example, if four groups are activated in sequence with a pulse duration of 2 milliseconds per group, the entire set of light-emitting devices 14 and 15 can be activated in 8 milliseconds, which means that the reflective fabric 10 attached to the ribs 11 on which the light-emitting devices 14 and 15 are mounted can be mapped at a rate of 125 Hz. By sequentially activating the light-emitting devices 14 and 15, the formation of overlapping bands of light on the photodetector arrays 31 and 32 can be prevented.

Figure 5:
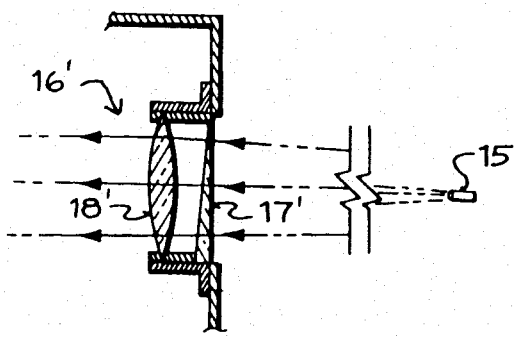
FIG. 5 is a cross-sectional view of a window assembly on the hub of the antenna figure control system shown in FIG. 2 in which optical paths are illustrated for three rays originating at a light source mounted at the outer tip of one of the ribs supporting the antenna.

FIG. 5 shows the window assembly 16' mounted in a representative one of the window slits through which a beam of light is admitted from the light-emitting device 15 located at the outer tip of a corresponding one of the ribs 11. The window assembly 16' comprises a prism 17' mounted at the entrance of the window slit, and a converging lens 18' mounted behind the prism 17'. The apex angle of the prism 17' of the window assembly 16' shown in FIG. 5 differs from the apex angle of the prism 17 of the window assembly 16 shown in FIG. 4, because the amount by which the rays coming from the light-emitting devices 15 must be deviated is different from the amount by which the rays coming from the light-emitting devices 14 must be deviated. Similarly, the surface curvatures and the axial thickness of the converging lens 18' of the window assembly 16' shown in FIG. 5 differ from the corresponding dimensions of the converging lens 18 of the window assembly 16 shown in FIG. 4, because the distances of the light-emitting devices 15 and 14 from their corresponding window slits on the cylindrical surface of the hub 12 are different.

The beam of light from any particular light-emitting device 14 or 15, after having passed through the corresponding window slit on the cylindrical surface of the hub 12, and after having been reflected by the reflective surfaces 28 and 29 of the biconical reflector 27 through the Schmidt corrector plate 25 to the primary mirror 21, and after having been reflected by the primary mirror 21 onto the secondary mirror 22, is focussed by the secondary mirror 22 through the beamsplitter 30 so as to form a pair of images (i.e., a pair of diffraction-limited arcs of light) on the corresponding pair of photodetector arrays 31 and 32. Since the cross section of the biconical reflector 27 is circular on every plane perpendicular to the optic axis of the telescope, the images formed on the photodetector arrays 31 and 32 are corresponding small segments of a large-radius circle. Each particular image appears on each of the photodetector arrays 31 and 32 as a nearly linear swath of light. There are as many swaths of light on each of the photodetector arrays 31 and 32 as there are light-emitting devices 14 and 15 emitting beams of light.

Figures 6, 7, 8, 9, 10:
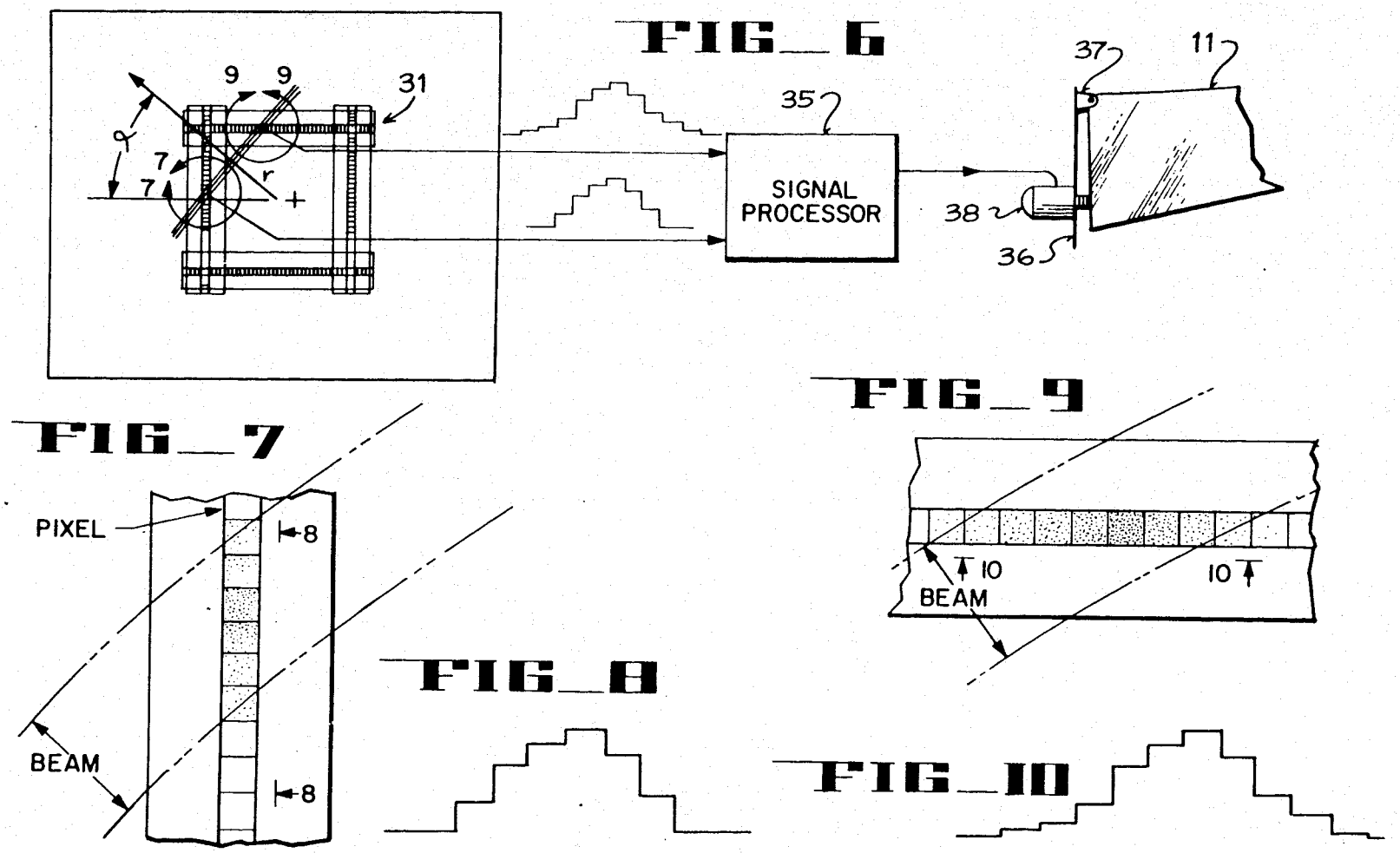
FIG. 6 is a schematic view of an array of photoelectric devices and associated electronic means for generating a correction signal to actuate means for changing the orientation of one of the ribs of the antenna figure control system of FIG. 1.
FIG. 7 is an enlarged view of a portion of the array of photoelectric devices encircled by line 7—7 in FIG. 6.
FIG. 8 is a graphical representation of the amplitude distribution along line 8—8 of FIG. 7 of an electronic pulse generated by the photoelectric devices illustrated in FIG. 7.
FIG. 9 is an enlarged view of a portion of the array of photoelectric devices encircled by line 9—9 in FIG. 6.
FIG. 10 is a graphical representation of the amplitude distribution along line 10—10 of FIG. 9 of an electronic pulse generated by the photoelectric devices illustrated in FIG. 9.

In the exemplary embodiment of the invention, each of the photodetector arrays 31 and 32 comprises four linear arrays of photoelectric devices, e.g., charge-coupled devices (CCD's), which are arranged as sides of an empty square matrix. In FIG. 6, the square matrix of CCD's comprising the photodetector array 31 is illustrated. A similar square matrix of CCD's comprises the photodetector array 32. On each of the photodetector arrays 31 and 32, the nearly linear swath of light focussed thereon crosses two of the linear arrays of CCD's (i.e., two adjacent sides of the square matrix) at positions that are determined by the angular orientation of the corresponding light-emitting device 14 or 15 relative to the cylindrical axis of the hub 12.

As shown in FIG. 6, the swath of light focussed onto the photodetector array 31 cuts across a number of linearly disposed CCD's on a first side of the square matrix, and across a number of linearly disposed CCD's on an adjacent second side of the square matrix. The CCD's activated by the swath of light crossing the linear array forming the first side of the square-matrix photodetector array 31 generate a first step-wise signal, whose width is determined by the width of the swath of light (i.e., by the number of CCD's activated by the swath of light). The pattern of this first signal can be processed to determine the location of the centroid of the swath of light on the first side of the photodetector array 31. Similarly, the CCD's activated by the swath of light crossing the linear array forming the adjacent second side of the square-matrix photodetector array 31 generate a second step-wise signal, whose width is determined by the width of the swath of light. The pattern of this second signal can be processed to determine the location of the centroid of the swath of light on the second side of the photodetector array 31. The centroid of each swath of light on each side of each one of the square-matrix photodetector arrays 31 and 32 can be determined by a conventional centroiding technique involving a simple first-moment (i.e., "center-of-gravity") calculation.

FIG. 7 shows an enlarged view of the swath of light crossing the first side of the photodetector array 31. The amplitude of the electronic response of each particular CCD activated by the swath of light crossing the first side of the photodetector array 31 varies with the intensity of the light transversely across the swath. As indicated graphically in FIG. 8, the CCD's activated by the swath of light crossing the first side of the photodetector array 31 produce electrical signals having stepped amplitudes corresponding to variations in the outputs of the individual CCD's due to the variations in intensity of the light transversely across the swath. The step-wise curve shown in FIG. 8 represents the effective electronic pulse generated when the swath of light crosses the first side of the photodetector array 31. Similarly, FIG. 9 shows an enlarged view of the same swath of light crossing the second side of the photodetector array 31. As indicated graphically in FIG. 10, the CCD's activated by the swath of light crossing the second side of the photodetector array 31 likewise produce electrical signals having stepped amplitudes corresponding to variations in the outputs of the individual CCD's due to variations in intensity of the light transversely across the swath. The step-wise curve shown in FIG. 10 represents the effective electronic pulse generated when the swath of light crosses the second side of the photodetector array 31.

The electrical signals produced by the photodetector array 31 serve as inputs to a signal processor 35, as schematically illustrated in FIG. 6. Similarly, the electrical signals produced by the photodetector array 32 also serve as inputs to the signal processor 35. The input electrical signals from the photodetector arrays 31 and 32 are analyzed by the signal processor 35 to determine the precise location of the particular light-emitting device 14 responsible for the swath of light that produces these inputs. When the light-emitting device 14 changes its location relative to the cylindrical axis of the hub 12 and the designated reference plane, the swaths of light crossing adjacent sides of each of the photodetector arrays 31 and 32 correspondingly change position. Determination of the positions of the centroids of the swaths of light crossing adjacent sides of each of the photodetector arrays 31 and 32 enables the precise location of the light-emitting device 14 to be determined.

The signal processor 35 determines the precise locations of all the light-emitting devices 14 and 15 on all the ribs 11 during a predetermined time interval by analyzing all the input signals produced by the photodetector arrays 31 and 32 during that time interval. The signal processor 35 electronically sweeps around the antenna, and determines the precise locations of each of the light-emitting devices 14 and 15 in succession (and thereby determines the precise orientations of the ribs 11) during the time interval of the sweep. Using a gate array marketed by LSI Logic Corporation of Milpitas, Calif. as the signal processor 35, a sweep time of 5 microseconds per centroid can be achieved. For a system comprising, e.g., fifty ribs 11, there would be 100 swaths of light (i.e., two swaths for each rib 11) on each of the photodetector arrays 31 and 32. For a sweep time of 5 microseconds per centroid plus an integration time of 6 microseconds (i.e., 2 ms×3 groups), the time interval required to sweep the entire system (i.e., to map the entire antenna) would be approximately 0.01 second, which implies a mapping data rate of approximately 100 Hz.

From the orientations of the ribs 11 during a sweep interval, the surface configuration (i.e., the figure) of the reflective fabric 10 secured to the ribs 11 as shown in FIG. 1 can be mapped. The signal processor 35 further comprises means for comparing the actual figure of the reflective fabric 10 during a sweep interval with a specified figure for the antenna, and means for generating electrical correction signals for activating mechanical means to move particular ones of the ribs 11 as necessary to bring the actual figure into conformity with the specified figure for the antenna.

In the embodiment illustrated in FIG. 2, the hub 12 includes an annular casing 36 surrounding a mid-portion of a cylindrical surface of the hub 12 on which the light sources 19 and 20 are mounted. A proximal end of each rib 11 is attached by means of a hinge joint 37 to an external surface of the casing 36 so that the rib 11 extends radially outward with respect to the cylindrical axis of the hub 12. A corresponding actuator mechanism 38 is secured to an interior surface of the casing 36, and an armature of the actuator mechanism 38 extends through an aperture in the casing 36 so as to abut the proximal end of the rib 11. Motion of the armature of the actuator mechanism 38 causes the rib 11 to rotate about the hinge joint 37 in plane defined by the rib 11 and the cylindrical axis of the hub 12. There is a corresponding actuator mechanism 38 for each rib 11, and the armature of any particular actuator mechanism 38 is caused to move by the corresponding correction signal generated by the signal processor 35 when necessary to rotate the corresponding rib 11 so as to bring the figure of the radio-frequency reflective fabric 10 into conformity with the specified figure for the antenna.

It will be appreciated that the figure control technique of the present invention is not limited in applicability to antennas that comprise fabric reflective surfaces and that use mechanical means for achieving figure correction. The figure control technique of the present invention can also be applied to an antenna that comprises an array of elements such as, e.g., dipole radiators or horn radiators, and that achieves figure control by electronic phase correction of individual elements of the antenna array.

Figures 11, 12, 13, 14, 15:
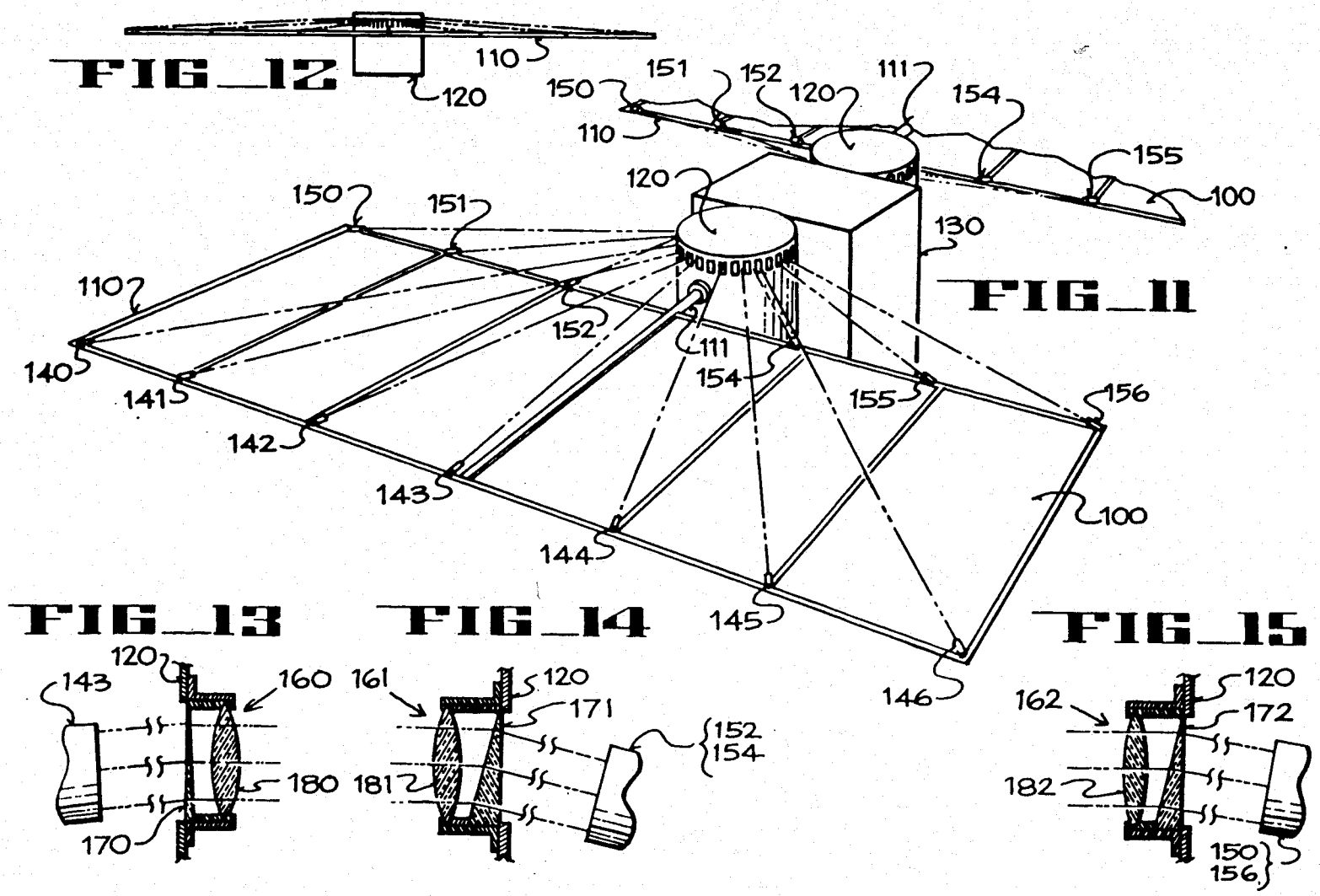
FIG. 11 is a perspective view of an alternative embodiment of the present invention comprising an unfolded phased-array antenna and its associated figure control system.
FIG. 12 is an elevation view of the phased-array antenna and its associated figure control system illustrated in FIG. 11.
FIG. 13 is a cross-sectional view of a window assembly on the hub of the figure control system of FIG. 11 in which optical paths are illustrated for three rays of light originating at a light source mounted on a distal side of an array-supporting framework at a specified location remote from the hub.
FIG. 14 is a cross-sectional view of a window assembly on the hub of the figure control system of FIG. 11 in which optical paths are illustrated for three rays of light originating at a light source mounted on a proximal side of the array-supporting framework at a specified location relatively near the hub.
FIG. 15 is a cross-sectional view of a window assembly on the hub of the figure control system of FIG. 11 in which optical paths are illustrated for three rays of light originating at a light source mounted on the proximal side of the array-supporting framework at a specified location relatively far away from the hub.

An alternative embodiment of an antenna and associated figure control system according to the present invention is illustrated in FIG. 11 in which an array 100 of antenna elements (e.g., ultra-high frequency dipole radiators) is secured to a framework 110. The framework 110 comprises hollow cylindrical struts, which can be folded in a conventional manner so that the array 100 of antenna elements can be pleated in a stowed configuration. Upon deployment, the struts forming the framework 110 acquire the open configuration shown in FIG. 11.

The framework 110 is mounted in a conventional manner on an elongate boom 111, which extends generally radially outward from a circularly cylindrical hub 120. The hub 120 functions both as a support structure for the boom 111 and as a housing for a telescope of the Schmidt-Cassegrain type. As indicated in FIG. 11, two (or even more) such hubs 120 can be supported on a mast or other type of support structure 130 projecting from (e.g.) a spacecraft, so that a corresponding plurality of antennas can be deployed from the spacecraft. The hub 120 with the boom 111 attached thereto can be rotated as a unit about an axis defined by the support structure 130 so as to tilt the framework 110 to any particular angular orientation required for optimizing the gain of the antenna. An elevation view of the hub 120 with the framework 110 attached thereto is shown in FIG. 12.

As shown in FIG. 11, light-emitting devices 140, 141, 142, 143, 144, 145 and 146 are mounted at precisely specified locations on a distal side of the framework 110, and light-emitting devices 150, 151, 152, 154, 155 and 156 are mounted at precisely specified locations on a proximal side of the framework 110. The light emitting devices 140, . . . , 146 and 150, . . . , 156 can be Selfoc lenses to which light is coupled by means of corresponding optical fibers in the manner described above in the discussion of the light-emitting devices 14 and 15 illustrated in FIGS. 1 and 2.

Each of the light-emitting devices 140, . . . , 146 and 150, . . . , 156 directs a beam of light to a corresponding window on the cylindrical surface of the hub 120. Each window on the hub 120 is configured as an elongate slit that extends parallel to the cylindrical axis of the hub 120, and all the window slits are parallel to each other with precisely specified spacings between adjacent window slits. The window slits are disposed in a geometrical arrangement such that top ends (or bottom ends) of all the slits lie on a plane (which is designated as a reference plane) perpendicular to the cylindrical axis of the hub 120. The angle between the cylindrical axis of the hub 120 and the beam of light entering a particular window slit from a corresponding particular one of the light-emitting devices 140, . . . , 146 and 150, . . . , 156 provides a measurement of the location of that corresponding particular light-emitting device relative to the cylindrical axis of the hub 120 and the reference plane. Measurements of the locations of the various light-emitting devices 140, . . . , 146 and 150, . . . , 156 relative to the cylindrical axis of the hub 120 and the reference plane provide an indication of the angular orientation of the framework 110 relative to the cylindrical axis of the hub 120.

Window assemblies analogous to the window assembly 16 shown in FIG. 3 are mounted in corresponding window slits on the cylindrical surface of the hub 120. Each window assembly comprises a prism and a converging lens, whose geometrical parameters (i.e., the apex angle for the prism, and the radii of curvature and the thickness for the lens) are precisely determined by the location of the corresponding light-emitting device with respect to the particular window slit through which the beam of light enters. Thus, the geometrical parameters of the prisms and converging lenses are different for window assemblies that receive beams of light from light-emitting devices located at different distances from the hub 120.

In FIG. 13, a window assembly 160 is illustrated, whose prism 170 and converging lens 180 are precisely dimensioned for mounting in the window slit through which a beam of light is received from the light-emitting device 143. In FIG. 14, a window assembly 161 is illustrated, whose prism 171 and converging lens 181 are precisely dimensioned for mounting in either the window slit through which the beam of light from the light-emitting device 152 is received, or the window slit through which the beam of light from the light-emitting device 154 is received. In FIG. 15, a window assembly 162 is illustrated, whose prism 172 and converging lens 182 are precisely dimensioned for mounting in either of the window slits through which a beam of light is received from the light-emitting device 150 or from the light-emitting device 156.

Figure 16:
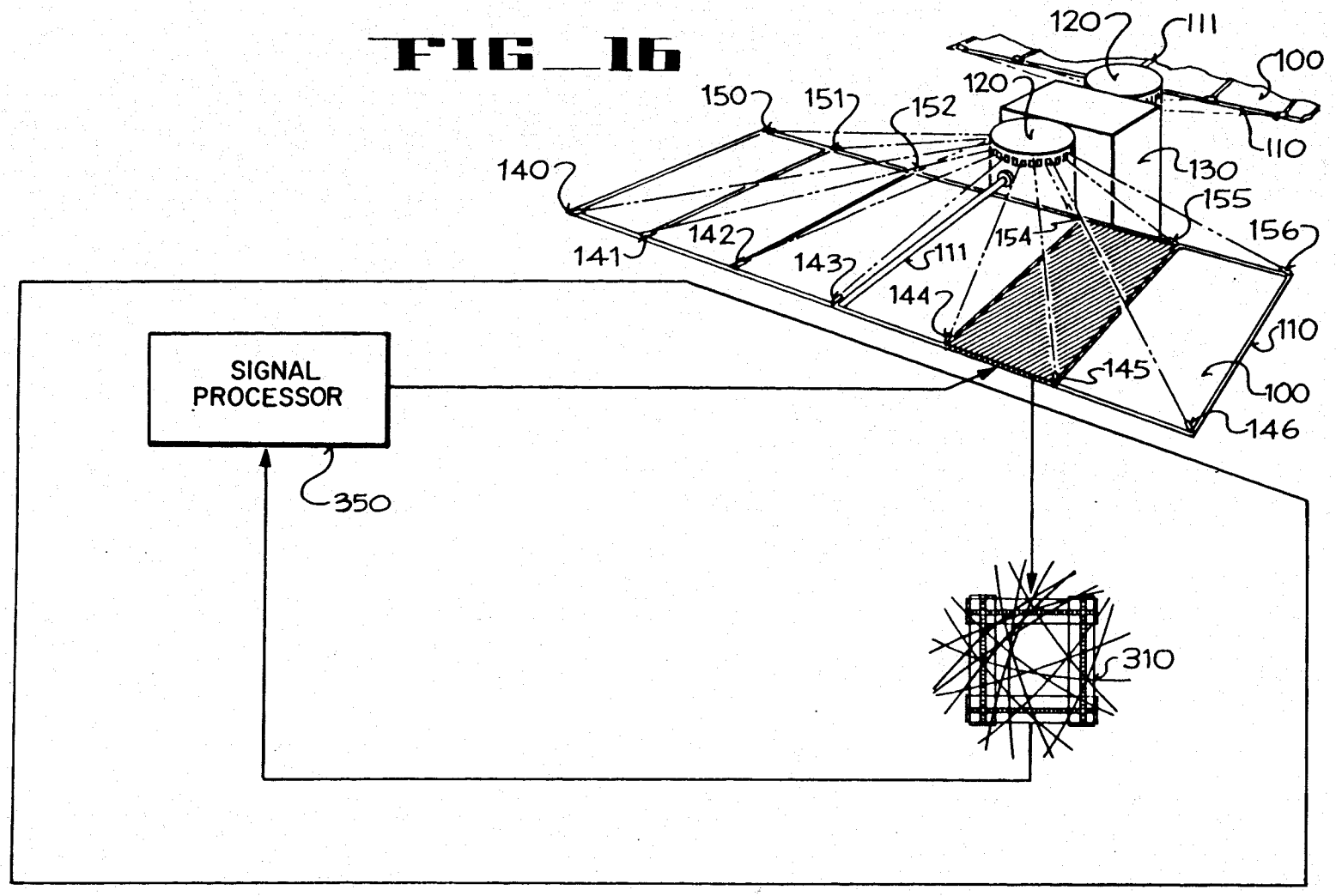
FIG. 16 is a perspective view of the phased-array antenna of FIG. 11 with a schematic illustration of the associated figure control system whereby phase correction of antenna elements can be effected electronically.

Figure control for each of the planar antennas illustrated in FIG. 11 could be implemented in various ways using techniques generally in accord with the principle described above used for controlling the figure of the paraboloidal antenna illustrated in FIGS. 1 and 2. Thus, as indicated in FIG. 16, a plurality of swaths of light (one from each of the light-emitting devices 140, . . . , 146 and 150, . . . , 156) could be detected by a single photodetector array 310 disposed within the hub 120. An optical system housed within the hub 120 would include appropriate beamsplitting and focussing means to cause images of the corresponding light-emitting devices to be focussed onto appropriate regions of the photodetector array 310 for generating electronic signals indicative of the angular orientations of the individual light-emitting devices.

As the swaths of light from the corresponding light-emitting devices 140, . . . , 146 and 150, . . . , 156 are simultaneously directed to the photodetector array 310, a condition might occur in which two (or more) swaths of light cross in the same area (i.e., at the same pixel) of the photodetector array 310, which could be a cause of ambiguity in mapping the locations of the individual light-emitting devices. A solution to this problem is to electronically designate any two or (more) light-emitting devices that produce intersecting swaths of light as a special group, each member of which is activated sequentially. Since saturation of each photodetector element of the array 100 occurs in approximately 2 ms, as many as five groups of sequentially activated light-emitting devices could be used before the data processing rate would slow to less than 100 Hz.

The signal processor 350 functions in substantially the same way as the signal processor 35 described above in connection with the discussion of FIG. 6, and comprises means for analyzing the input signals generated by the CCD's comprising the photodetector array 310 to determine the precise locations of the corresponding light-emitting devices 140, . . . , 146 and 150, . . . , 156. From a determination of the precise locations of the light-emitting devices 140, . . . , 146 and 150, . . . , 156, the figure of the array 100 of antenna elements can be mapped. The signal processor 350 further comprises means for comparing the actual figure of the array 100 during a given interval of time with a specified figure, and for generating electrical correction signals for electronically changing the phase of individual antenna elements as necessary to bring the actual figure of the array 100 into conformity with the specified figure.

Figure 17:
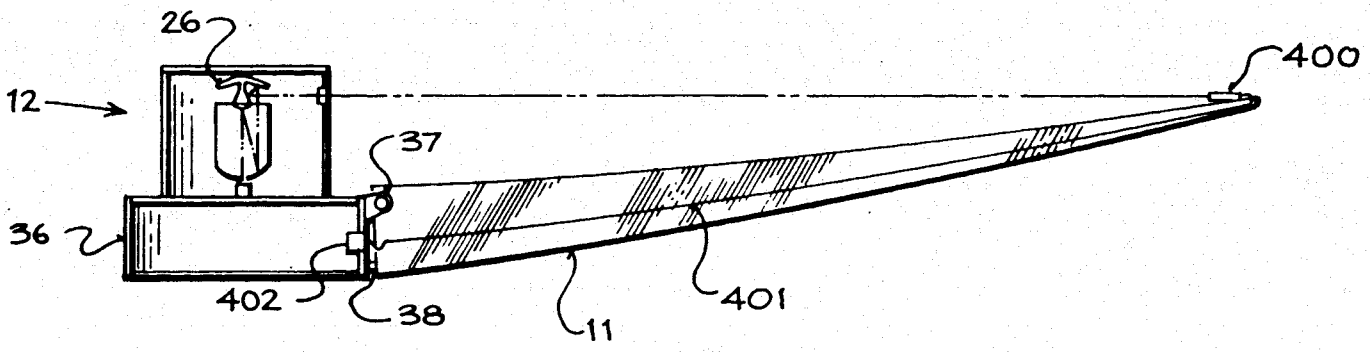
FIG. 17 is a simplified sketch in cross-sectional view of a figure control system for an antenna generally as illustrated in FIG. 1 wherein a light source is located at the tip of each hinged rib supporting the antenna.
Figure 18:
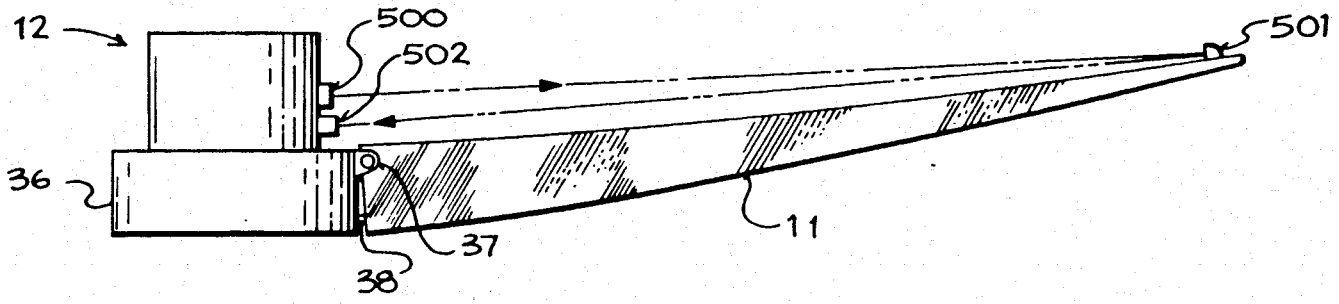
FIG. 18 is a simplified sketch in cross-sectional view of a figure control system for an antenna generally as illustrated in FIG. 1 wherein a light source is located on the hub, and a reflector is located at the tip of each hinged rib supporting the antenna.

The present invention has been described above in terms of particular embodiments. However, practitioners in the antenna art, upon perusing the foregoing specification and the accompanying drawing, would be able to devise other embodiments of the invention suitable for particular applications. Thus, as illustrated in FIG. 17, a light source 400 (rather than a light-emitting device such as a Selfoc lens as shown in FIG. 2) could be located at the outer tip of each of the ribs 11. By locating the light source 400 at the outer tip of the rib 11, the need for an optical fiber to deliver light to a light-emitting device at the outer tip is eliminated. The light source 400 can be activated by means of an electrically conductive wire 401 extending to the light source 400 from a power supply 402 mounted inside the annular casing 36. Similarly, light sources could be provided instead of Selfoc lenses at the mid-positions on the ribs 11 of an antenna as shown in FIG. 2. In another alternative embodiment, instead of using optical fibers to deliver light to corresponding light-emitting devices on each of the ribs 11, visible-light reflectors can be mounted at precisely located positions on each of the ribs 11, and corresponding light sources can be mounted on the cylindrical surface of the hub 12 so as to project beams of visible light to the corresponding reflectors. Thus, as illustrated in FIG. 18, a light source 500 mounted on the cylindrical surface of the hub 12 projects a beam of visible light to a reflector 501 located at the outer tip of the rib 11. The reflector 501 is oriented to reflect the beam back either to a corresponding elongate slit on the cylindrical surface of the hub 12 for transmission by means of a biconical reflector and a Schmidt-Cassegrain telescope (as shown in FIG. 2) to photodetector means for generating input signals from which the figure of the antenna can be mapped, or alternatively (as indicated in FIG. 18) to a corresponding photodetector array 502 also located on the cylindrical surface of the hub 12.

The foregoing descriptions of alternative embodiments are to be understood as merely descriptive of the invention, which is more generally defined by the following claims and their equivalents.

I claim:

1. An apparatus for controlling the figure of a flexible antenna, said apparatus comprising:

a) a framework for supporting said flexible antenna, said framework comprising a plurality of support members independently movable with respect to each other;

b) means attached to said plurality of support members for generating a corresponding plurality of optical signals;

c) means responsive to said plurality of optical signals for indicating precise locations of said support members, and concomitantly for determining an actual figure for said flexible antenna during a specified time interval; and d) means responsive to said actual figure for generating electrical signals to actuate mechanical means for moving said support members independently of each other so as to change said actual figure of said flexible antenna as determined for said specified time interval into conformity with a specified figure.

2. The apparatus of claim 1 wherein said means attached to said plurality of support members for generating said corresponding plurality of optical signals comprises a plurality of light-emitting devices, each of said light-emitting devices being attached to a specified portion of said framework for supporting said flexible antenna.

3. The apparatus of claim 1 wherein said framework comprises a plurality of ribs extending generally radially from a hub, said flexible antenna being attached to said ribs.

4. The apparatus of claim 3 wherein said means attached to said plurality of support members for generating said corresponding plurality of optical signals comprises a plurality of light-emitting devices, each of said light-emitting devices being attached to a corresponding one of said ribs.

5. The apparatus of claim 4 wherein two of said light-emitting devices are attached to each of said ribs.

6. The apparatus of claim 1 wherein said means responsive to said plurality of optical signals for determining said precise locations of said support members comprises means for focussing said optical signals onto photodetector means, said photodetector means being responsive to said optical signals so as to generate electronic signals that are indicative of said precise locations of said support members.

7. The apparatus of claim 6 wherein said means for focussing said optical signals comprises a telescope of the Schmidt-Cassegrain type, and means for directing said optical signals to said telescope.

8. The apparatus of claim 7 wherein said means for directing said optical signals to said telescope comprises a biconical reflector configured so as to direct said optical signals to said telescope as beams of light that are substantially parallel to an optic axis of said telescope.

9. The apparatus of claim 6 wherein said photodetector means comprises a beamsplitter for dividing each of said optical signals into two components, and a pair of photodetector arrays, each photodetector array being positioned substantially at a focal surface of a corresponding one of said components of each of said optical signals.

10. The apparatus of claim 9 wherein each of said photodetector arrays comprises four linear arrays of photodetector devices arranged as sides of a square.

* * * * *